US009850645B2

(12) United States Patent
Coulter et al.

(10) Patent No.: US 9,850,645 B2
(45) Date of Patent: Dec. 26, 2017

(54) FLOATING AUTOMATIC TOILET BOWL CLEANING DEVICE

(71) Applicant: The Clorox Company, Oakland, CA (US)

(72) Inventors: Sarah Coulter, Pleasanton, CA (US); Elizabeth Knipmeyer, Pleasanton, CA (US); Andrew Kilkenny, Pleasanton, CA (US); Stephen R. Dennis, Danville, CA (US); Kerry Azelton, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 796 days.

(21) Appl. No.: 14/030,899

(22) Filed: Sep. 18, 2013

(65) Prior Publication Data

US 2015/0074888 A1 Mar. 19, 2015

(51) Int. Cl.

| | |
|---|---|
| ***E03D 9/02*** | (2006.01) |
| ***E03D 9/00*** | (2006.01) |
| ***E03D 9/03*** | (2006.01) |

(52) U.S. Cl.

CPC ..... *E03D 9/007* (2013.01); *E03D 9/038* (2013.01)

(58) Field of Classification Search

USPC ..... 4/227.1, 227.4

See application file for complete search history.

(56) References Cited

U.S. PATENT DOCUMENTS

| | | | | |
|---|---|---|---|---|
| 2,210,924 A | | 8/1940 | Hood | |
| D252,337 S | * | 7/1979 | Hehnen | D23/207 |
| 4,416,854 A | * | 11/1983 | Nielsen | A01N 59/16 205/701 |
| 5,064,624 A | * | 11/1991 | King | A61L 9/12 137/268 |
| 5,181,281 A | | 1/1993 | Jang | |
| 5,188,550 A | * | 2/1993 | Oliver | F24J 2/0472 126/567 |
| 6,503,467 B1 | * | 1/2003 | Robinson, Sr. | A01K 63/04 137/268 |

(Continued)

FOREIGN PATENT DOCUMENTS

| | | |
|---|---|---|
| JP | 56013076 A | 2/1981 |
| JP | 63099006 A | 4/1988 |

(Continued)

*Primary Examiner* — Lauren Crane

(74) *Attorney, Agent, or Firm* — Erin Collins

(57) ABSTRACT

The invention relates to free floating automated toilet bowl cleaning devices that dispense a volatile composition (e.g., a fragrance) into air surrounding the toilet and dispense a cleaning composition (e.g., hypohalite bleach) into toilet tank water on which the device freely floats. The device includes a first compartment for housing the volatile composition. The first compartment is permeable to air, with the permeable portion of the first compartment positioned above a water line when the device is floated. The device includes a second compartment for housing the cleaning composition. The second compartment includes one or more inlets through the device body to allow fluid communication with the liquid on which the device floats during use. A floatation member is positioned above the second compartment (e.g., between the first and second compartments).

19 Claims, 6 Drawing Sheets

(56) References Cited

U.S. PATENT DOCUMENTS

| | | | | |
|---|---|---|---|---|
| 6,654,970 | B1 | 12/2003 | Van | |
| 6,662,379 | B2 | 12/2003 | Nguyen et al. | |
| 6,901,609 | B2 * | 6/2005 | Hill | A01M 1/02 4/222 |
| 6,944,889 | B2 | 9/2005 | Hill | |
| 7,721,358 | B2 | 5/2010 | Park et al. | |
| 2003/0180340 | A1 * | 9/2003 | Birch | C11D 3/505 424/401 |
| 2010/0205730 | A1 | 8/2010 | Muhlhausen et al. | |
| 2010/0212074 | A1 * | 8/2010 | Burt | E03D 9/007 4/231 |
| 2010/0235976 | A1 | 9/2010 | Cooper et al. | |
| 2012/0131739 | A1 | 5/2012 | Burt | |
| 2012/0210504 | A1 * | 8/2012 | Lin | E03D 9/038 4/227.1 |

FOREIGN PATENT DOCUMENTS

| | | | |
|---|---|---|---|
| JP | 09141254 | A | 6/1997 |
| WO | 200986948 | A1 | 7/2009 |

* cited by examiner

FLOATING AUTOMATIC TOILET BOWL CLEANING DEVICE

BACKGROUND OF THE INVENTION

1. The Field of the Invention

The present invention relates to toilet cleaning devices, particularly to devices for automatically delivering a bleach component into toilet water.

2. Description of Related Art

Nearly every consumer is familiar with the necessary but undesirable task of cleaning the toilet. In an effort to improve the cleanliness of the toilet bowl and water contained therein, particularly between cleanings, various devices for automatically cleaning the water contained within a toilet bowl have been developed. Some of the toilet cleaning devices are placed in the tank of the toilet and others are designed to be placed in the bowl of the toilet. One common problem of many of these toilet water cleaning devices or tablets is that they employ an oxidizing or bleaching agent which may be incompatible with a fragrance or dye composition. Consequently, it is known in the art to make toilet rim hangers with a fragrance and/or dye composition which remains physically separated from a bleach containing composition. Similarly, some tablets have two components where one half contains the bleaching composition and the other half contains a dye, fragrance, surfactants (e.g. 2000 Flushes® Blue Plus Bleach, Clorox® Automatic Toilet Bowl Cleaner Bleach & Blue, etc.).

The art also discloses floating devices adapted for diffusing soluble substances in the bathing water, pools and hot tubs. Such disclosures include JP-63099006-A which discloses a sealing bag comprising a bathing agent and which is capable of uniformly diffusing the bathing agent into bath hot water; JP-09141254-A which discloses a synthetic resin mold for fragrances the hot water remaining in the bath; JP-56013076-A which discloses a bath perfuming implement comprising a perfume container associated with the lower part of a floating member and a porous part fitted to the perfume container part wherein the arrangement also includes an oleophilic substance applied to the floating member and adapted to remove dirt comprised of fatty materials floating on the surface of the bath water; and WO 00/67704 which discloses a container suitable for cosmetics, fragrances and the like wherein the container itself is formed from sodium bicarbonate and an acid, or from soap, and which therefore rapidly disperses in bathing water. U.S. Pat. No. 6,944,889 to Hill teaches a floating device with separate chambers for dispensing volatile and soluble substances at the same time.

While existing devices may be helpful in improving the cleanliness of the water contained within a toilet bowl, a continuing need for improved devices remains. Although the prior art provides useful teaching in the field of fragrancing water, or adding multiple additives to the water by means of a floating single or multi-chambered device, there remains a need for a device that can float in a consistently upright position and/or right itself if submerged briefly so that the volatile composition remains substantially above the waterline and the cleaning composition remains at least partially below the waterline.

It is therefore an object of the present invention to provide a dual action dispensing device which is able to act at the interface of a liquid with a gas and dispense a volatile substance into the atmosphere whilst simultaneously or sequentially dispensing a soluble cleaning substance into the liquid. It is a further object of this invention to provide dispensing devices which can maintain an upright orientation in where there is pressure to submerge and/or capsize the device in the liquid. Not only does this invention provide a dual action benefit but it also enables the benefits to be delivered over a longer period of time than has been possible to date and enables the delivery of a superior rendition of the fragrance such that more complex, subtle and delicate fragrances can be delivered than has been possible previously.

BRIEF SUMMARY OF THE INVENTION

In an embodiment, the present invention is directed to a device for dispensing a volatile composition into air, and a cleaning composition into toilet tank water which tank water is supplied to the toilet bowl. The device is floatable on water within the toilet tank. The device includes a first compartment for housing the volatile composition wherein the first compartment is permeable to air and the permeable portion of the first compartment is positioned above a water line when the device is floating (e.g., in a toilet tank). In one embodiment, the device further includes a floatation member positioned at least partially between the first compartment and a second compartment. In another embodiment the floatation member is positioned at substantially the same level or below the first compartment. The flotation member may be a separable or independent portion of the device (e.g. foam structure, an air-filled container, etc.) Alternatively, the floatation member maybe integrated or inseparable from the cleaning composition (e.g. the cleaning composition itself may be a porous solid that floats or air may be trapped in the in the cleaning composition to allow the composition to float, etc.) The second compartment houses the cleaning composition (e.g., which may deliver hypochlorite bleach to the tank water), and the second compartment includes one or more inlets to allow fluid communication with the liquid on which the device floats during use.

Another embodiment of the present invention is directed to a device for dispensing a volatile composition into air and dispensing a cleaning composition into toilet tank water, the device being floatable on water. The device includes a first compartment for housing the volatile composition, wherein a top of the first compartment is open to the air and the top of the first compartment is positioned above a water line when the device is floating. The device further includes a second compartment for housing the cleaning composition, which second compartment includes one or more inlets to provide fluid communication between the second compartment and the liquid on which the device floats during use. The device also includes a floatation member positioned above or at substantially the same height as the second compartment. The flotation member may be a separable or independent portion of the second compartment (e.g. foam structure, an air-filled container, etc.) Alternatively, the floatation member maybe integrated or inseparable from the second compartment (e.g. the second compartment may be at least partially made out of a material or materials that float on water).

Another embodiment of the present invention is directed to a device for dispensing a volatile fragrance composition into air and dispensing a hypohalite bleach cleaning composition into toilet tank water, the device being floatable on water. The device includes a first compartment for housing the volatile fragrance composition, wherein a top of the first compartment is at least partially open to the air and the top of the first compartment is positioned at least partially above a water line when the device is floating so that the liquid on which the device floats and the water does not cover the volatile fragrance composition. Due to rough water or submerging forces (e.g. created by flushing a toilet) the device may be pulled underwater briefly, but the device will immediately return to an upright floating position after the force pulling it down subsides. In a preferred embodiment, the water will not be in contact with the volatile composition when the device is in an upright floating position. The device further includes a second compartment for housing the cleaning composition which is at least partially below the waterline when the device is floating in an upright position. In one embodiment, the cleaning composition comprises a hypohalite bleach. The second compartment includes one or more inlets to provide fluid communication between the second compartment and the liquid on which the device floats so that liquid on which the device floats contacts the cleaning composition during use. The device also includes a floatation member positioned substantially at the same level or above the second compartment (e.g., between the first and second compartments or adjacent to the bottom of the first compartment and/or the top of the second compartment).

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1A:
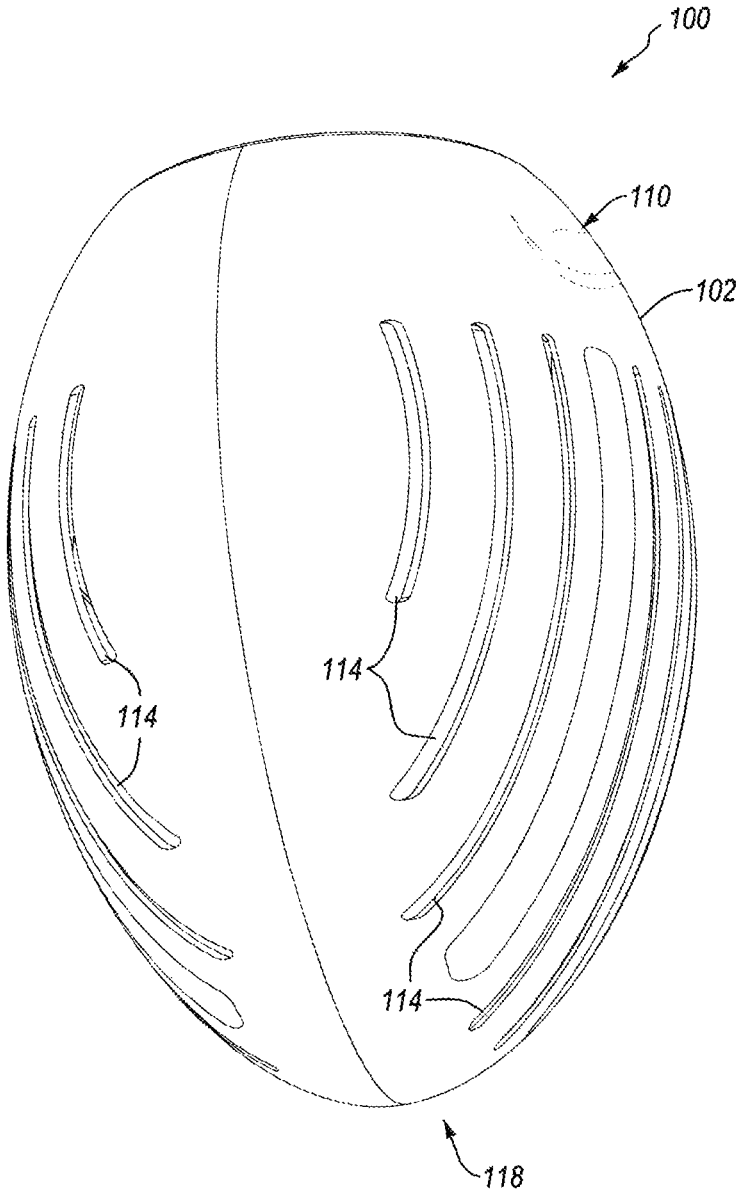
FIG. 1A is an isometric view of an exemplary floating automatic toilet bowl cleaning device.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentages ("wt %'s") are in wt % (based on 100 weight % active) of the particular material present in the referenced composition, any remaining percentage typically being water or an aqueous carrier sufficient to account for 100% of the composition, unless otherwise noted. For very low weight percentages, the term "ppm" corresponding to parts per million on a weight/weight basis may be used, noting that 1.0 wt % corresponds to 10,000 ppm.

II. Introduction

The present invention is directed to free floating automated toilet bowl cleaning devices, e.g., that may be floated on water within a toilet tank, without any requirement that the device be attached to the toilet tank itself (e.g., by means of a hanger, clip, or similar structure). The device advantageously provides for delivery of a cleaning composition (e.g., a hypohalite bleach, hydantoin, surfactants, etc.) into the water of the toilet tank. The cleaning composition (e.g., in the form of a solid tablet or "puck", granular, liquid, gel, etc.) may be housed within the device. The cleaning composition may contain multiple components that could be in one or more forms (e.g. a solid and a gel or a liquid and particulates, etc.) Where the cleaning composition comprises a form (e.g. liquid, gel, etc.) or chemical components that would dissolve too rapidly, it may be desirable to slow down the rate of dissolution to control the release of actives over time. Suitable mechanisms for controlled release, include but are not limited to, a gradient membrane, a pH equilibrium, osmotic pressure regulation, mechanical dosage mechanisms which release a dosage amount of actives over time and/or in response to movement of the device, etc.) The device may further be configured to dispense a volatile composition (e.g., a fragrance, deodorizer, etc.) into air (e.g., the air in the head space of the toilet tank, which then diffuses into the surrounding air outside the toilet tank, throughout a bathroom).

The device may include a first compartment for housing the volatile composition, and a second compartment for housing the cleaning composition. The device may further include a floatation member (e.g., a sealed air-filled compartment, foam member, a porous solid cleaning composition, etc.) disposed above the second compartment (e.g., between the first and second compartments) to provide a degree of buoyancy to the device that allows water from the toilet tank to contact the cleaning composition within the second compartment (e.g., through inlets formed in the lower portion of the device, adjacent the second compartment). The device may have a center of buoyancy and center of gravity so that it floats in a longitudinally aligned or upright (i.e., substantially "vertical") orientation upon the water. The majority of the device may reside below the water line when floating. The device is configured so that the degree of buoyancy (e.g., how "high" or "low" the device rides in the water) positions open portions of the first compartment above the water line, so that the water within the toilet bowl does not cover, or preferably does not contact, the volatile composition within the first compartment.

III. Exemplary Automated Toilet Bowl Cleaning Devices

FIGS. 1A-2B illustrate various views of an exemplary automated toilet bowl cleaning device 100. Device 100 includes a body 102 defining a first compartment (e.g., an upper compartment) 104 and a second compartment (e.g., a lower compartment) 106. First compartment 104 may house a volatile fragrance composition 108. First compartment 104 may be permeable to the air. For example, it may be open at the top 105 or may include inlets through which contact with the air may be provided. Any such inlets or open top 105 may advantageously be positioned at least partially above a water line (e.g., water line 110) when the device is floated. Such a configuration prevents water from covering and/or contacting the volatile composition, which is intended to deliver a volatile (e.g., fragrance) into the air above the water line.

Second compartment 106 may be disposed below first compartment 104, and may house a cleaning composition, e.g., a solid "puck" or tablet comprising a hypohalite bleach producing component. For example, cleaning composition 112 may comprise a hypochlorite (e.g., sodium hypochlorite, hydantoin bleach, etc.) or hypochlorite producing component or surfactant solution. Device body 102 may include one or more inlets 114 into second compartment 106, providing fluid communication between water on which the device 100 floats and the cleaning composition 112 housed within second compartment 106. Thus, water may freely enter device 100 through inlets 114, contacting cleaning composition 112. Cleaning composition may be a solid composition, e.g., in the form of a tablet or "puck", which releases a hypohalite (e.g., hypochlorite) species into the water upon contact. As the device may be floated on the water within a toilet tank continuously, the cleaning composition may continuously release hypohalite and/or any other desired components (e.g., surfactants, acids, buffers, etc.) into the water during its useful life.

Device 100 further includes a floatation member 116. Floatation member 116 may comprise any structure or materials configured to increase the buoyancy of device 100. For example, in an embodiment, floatation member 116 may comprise a sealed air-filled compartment. In one embodiment, as perhaps best seen in the exploded view of FIG. 1C, floatation member 116 may comprise an air-filled body separate from shell-like body 102 of device 100. In another embodiment, floatation member 116 may be integrally connected with body 102 (e.g., it may be glued, otherwise fastened thereto, integrally formed therewith, etc.).

Floatation member 116 may be disposed above second compartment 106 and cleaning composition 112 (e.g., between first compartment 104 and second compartment 106), facilitating at least a portion of inlets 114 being below water line 110 so as to provide water contact with cleaning composition 112. At the same time, such positioning ensures that the permeable portion (e.g., open top 105) of first compartment 104 is positioned substantially above water line 110, preventing or at least minimizing (e.g., due to splashing, temporary submersion, etc.) water contact with volatile composition 108, which is in contact with the air above water line 110, rather than the water below water line 110.

Figure 2B:
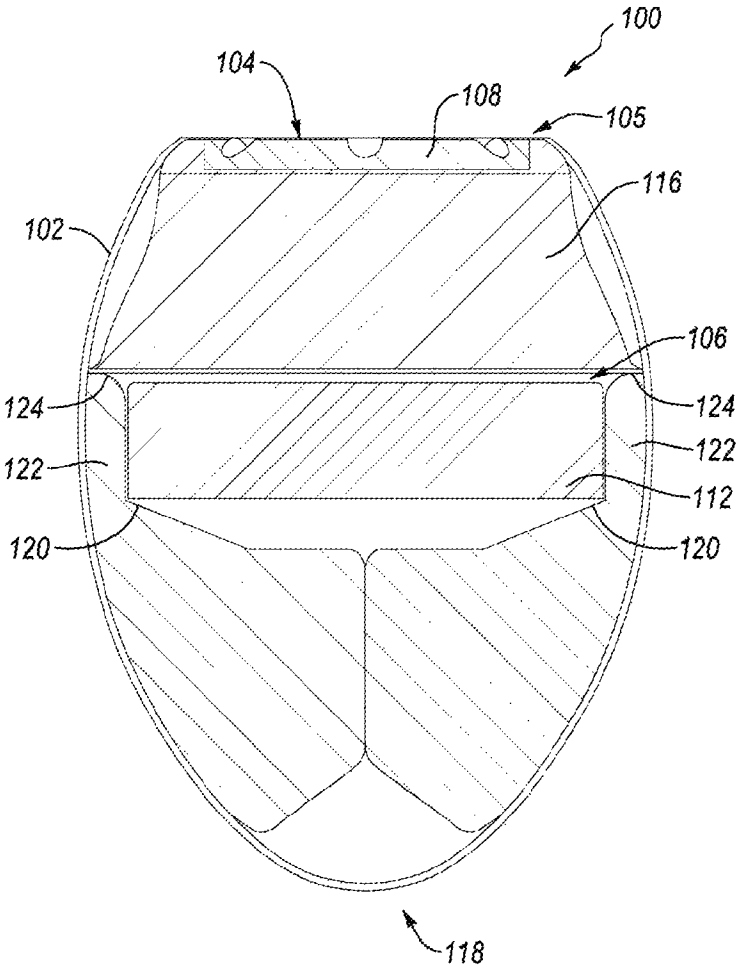
FIG. 2B is a cross-sectional view through the device of FIG. 1A.
Figure 2A:
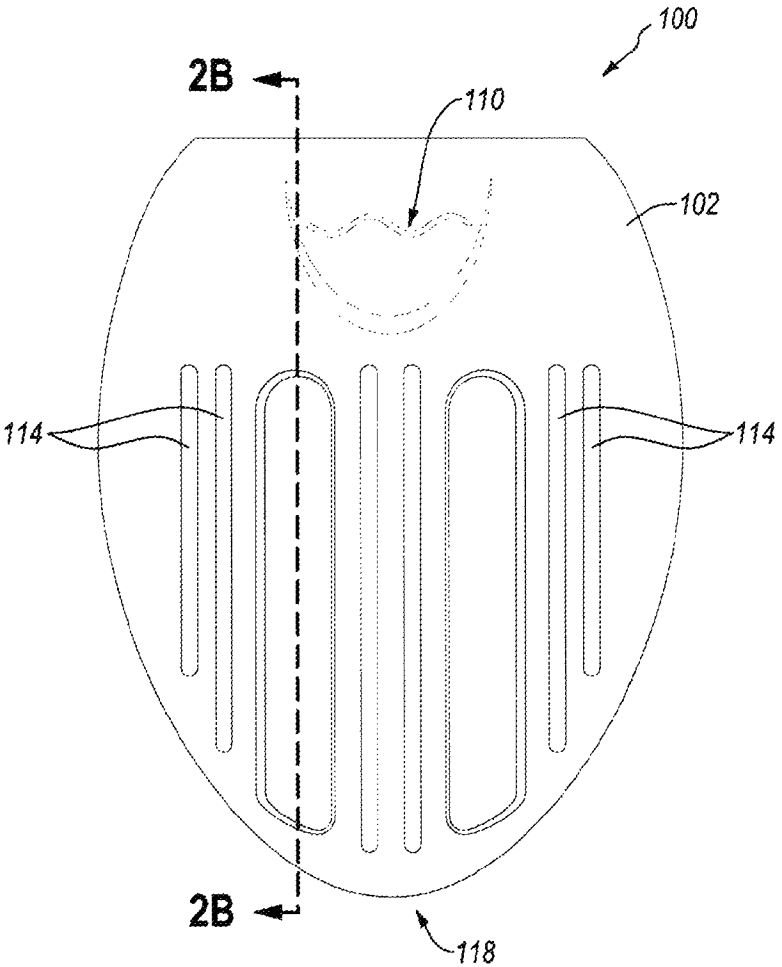
FIG. 2A is a side view of the device of FIG. 1A.

As perhaps best seen in the cross-sectional view of FIG. 2B, device 100 may include one or more support members 120 which at least partially define second compartment 106, providing a "shelf" upon which cleaning composition 112 may be supported. The support members 120 and compartment 106 may be configured to support cleaning composition 112 while also allowing water to contact at least a portion of one or more of the top, circumferential, or bottom surfaces of a tablet or "puck" shaped cleaning composition 112. In other words, at least a portion of a bottom of compartment 106 may be open, so as to allow water to enter therein, contacting cleaning composition 112.

As seen in FIG. 2B, support members 120 may also include an upward extension 122 which may serve to hold cleaning composition 112 in place, as well as providing a "shelf" surface 124 on which a lower lip of floatation member 116 may be supported. Depending on the thickness of cleaning composition 112, a gap may or may not be provided between the bottom surface of floatation member 116 and cleaning composition 112. Providing a gap between may be helpful in ensuring that water contacts at least a portion of the upper surface of cleaning composition 112, if desired.

Figure 3A:
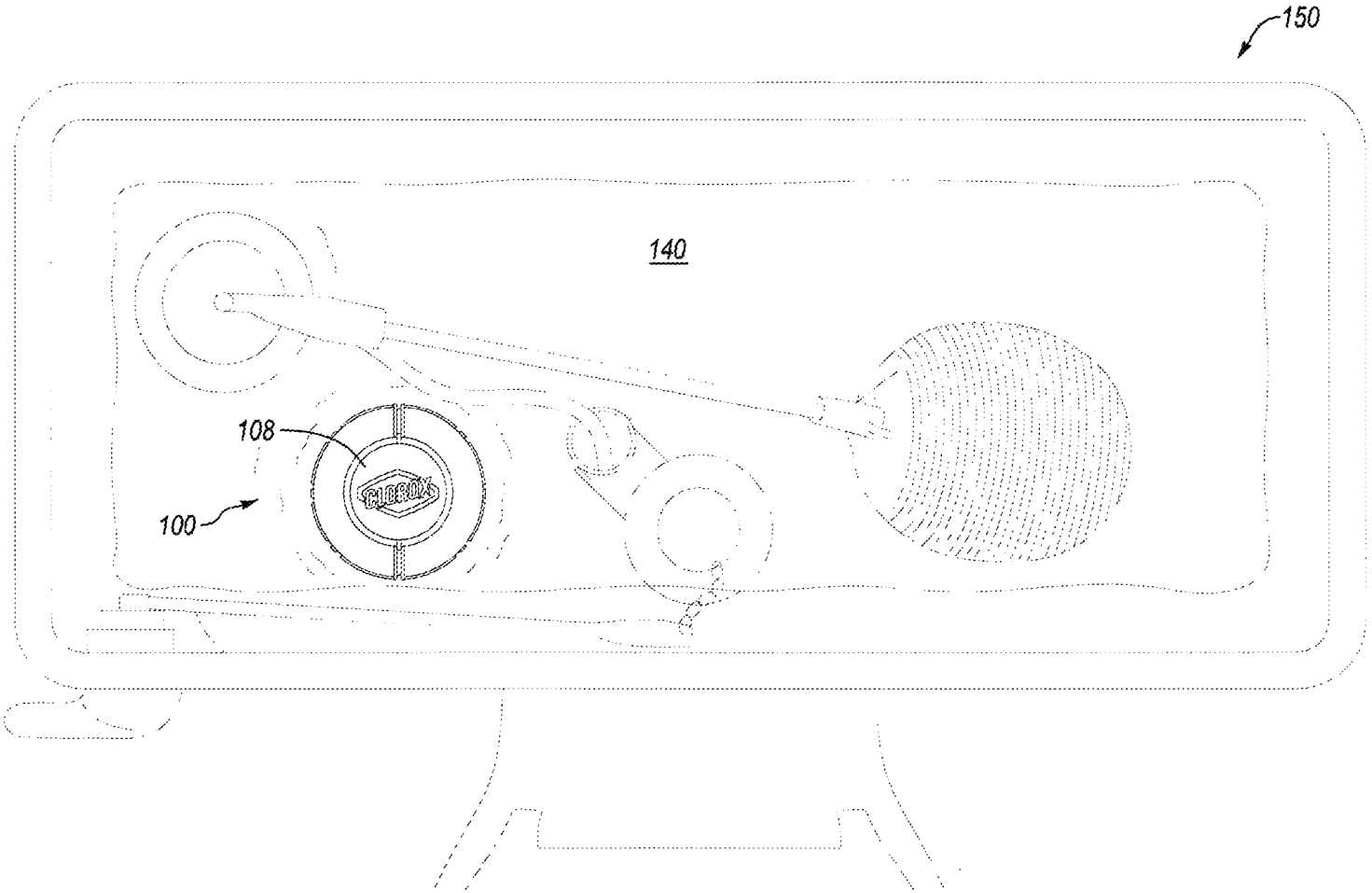
FIG. 3A is a perspective view showing the device of FIG. 1A floating freely within a toilet tank.
Figure 3B:
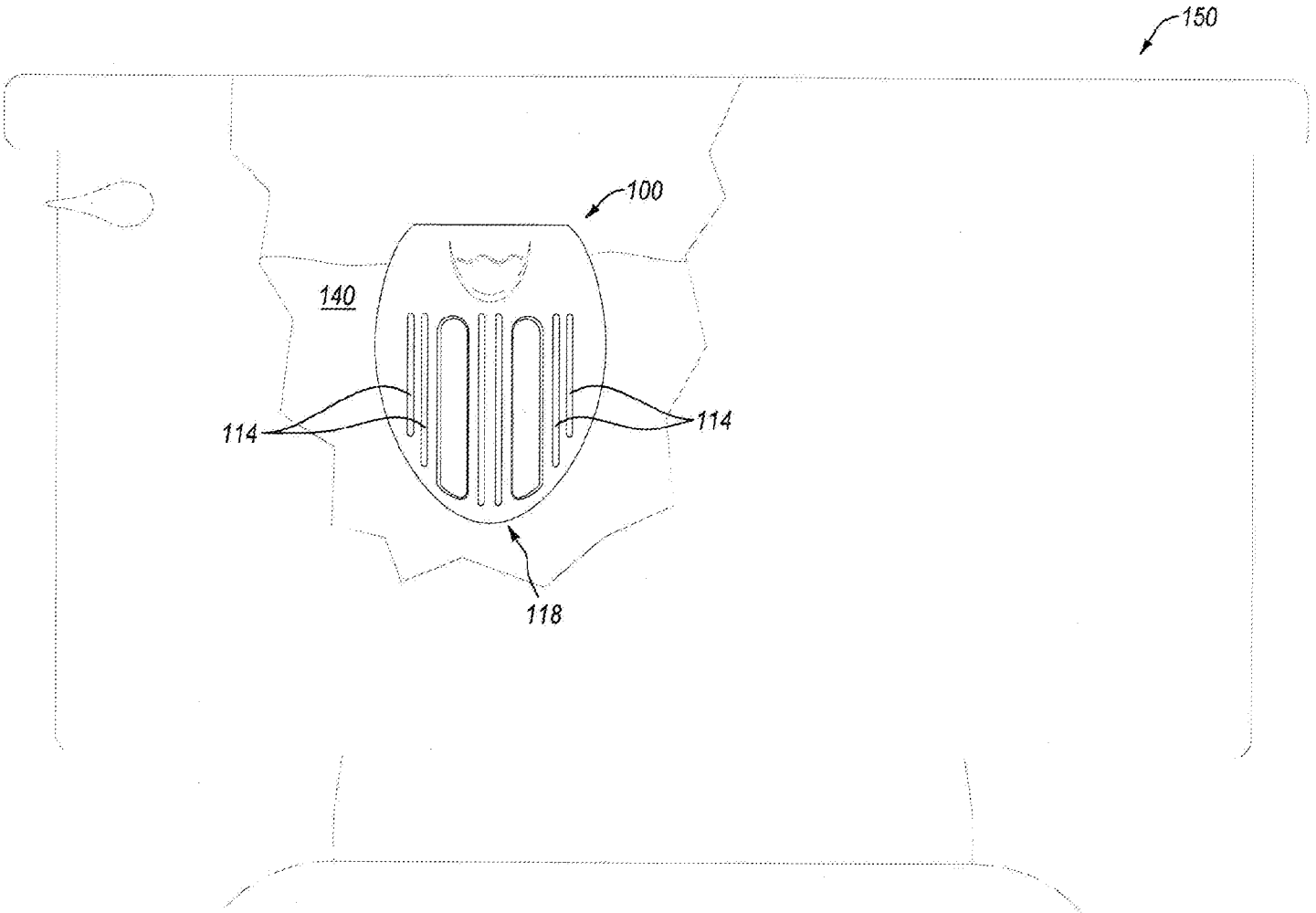
FIG. 3B is a partial cut away view into the toilet tank of FIG. 3A showing the device of FIG. 1A floating freely on the water within the toilet tank.

Device 100 advantageously does not require attachment to a rim or other surface of the toilet tank, but may advantageously float freely within the toilet tank. As such, device 100 is allowed to rise or drop with the particular water level at any given time. For example, when the tank is relatively full before flushing, device 100 will be vertically higher within the tank, and upon flushing, as the water level 110 drops, device 100 likewise drops with the water level, rising again as the tank refills. The proportion of device 100 that remains below the water line 110 (i.e., how "high" or "low" device 100 rides in the water) may remain substantially constant during such changes in water level. FIGS. 3A and 3B show how device 100 may freely float within water 140 in toilet tank 150.

In order to aid in providing the desired buoyancy characteristics to device 100, device 100 may include a center of gravity that is below a center of buoyancy. Such characteristics increase the stability of device 100 as it floats freely, in a longitudinal, "vertical" orientation, upon water 140 within toilet tank 150. In addition, a bottom surface 118 of device 100 may be curved (e.g., having a rounded bottom). The curvature may be compound, curving in both dimensions (e.g., depth and width) to provide a bottom surface 118 and associated bottom portion that exhibits a transverse cross-sectional area that decreases as the bottom surface 118 is approached. In other words, as one moves longitudinally towards bottom 118, the cross-sectional area through any given portion becomes smaller as one approaches the bottom surface 118 of device 100. This compound curvature, rounded bottom is readily apparent in several of the Figures, e.g., 1A, 2A and 2B. Such a smooth, rounded bottom configuration (e.g., without significant projections therefrom) aids in preventing device 100 from being pulled into, and particularly from becoming entrapped or otherwise entangled within the drain, valve seat, or other internal tank components as the toilet tank is flushed. It should be apparent that this feature of a curved bottom may be advantageous in other related fields where floating devices frequently get stuck in drains or outlets (e.g. pool cleaners/filters, hot tub cleaner/filters, etc.).

Figure 1B:
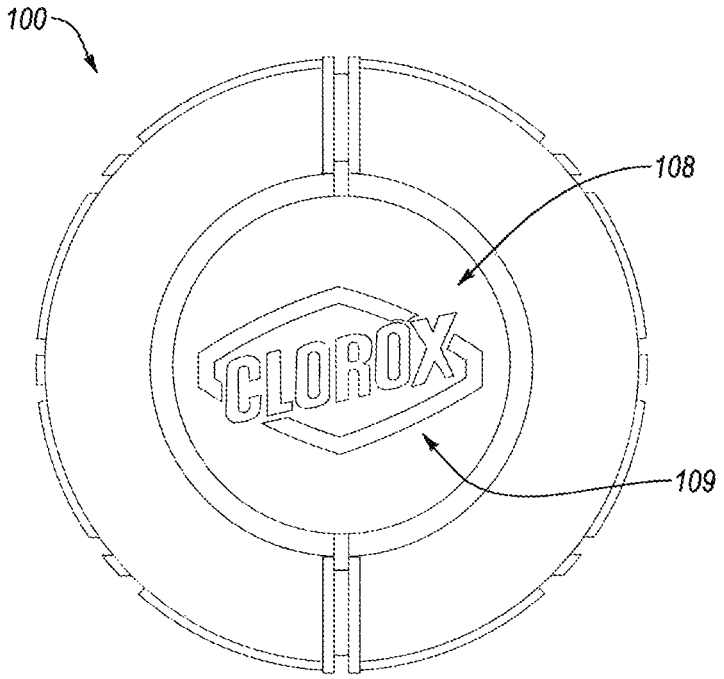
FIG. 1B is a top view of the device of FIG. 1A.
Figure 1C:
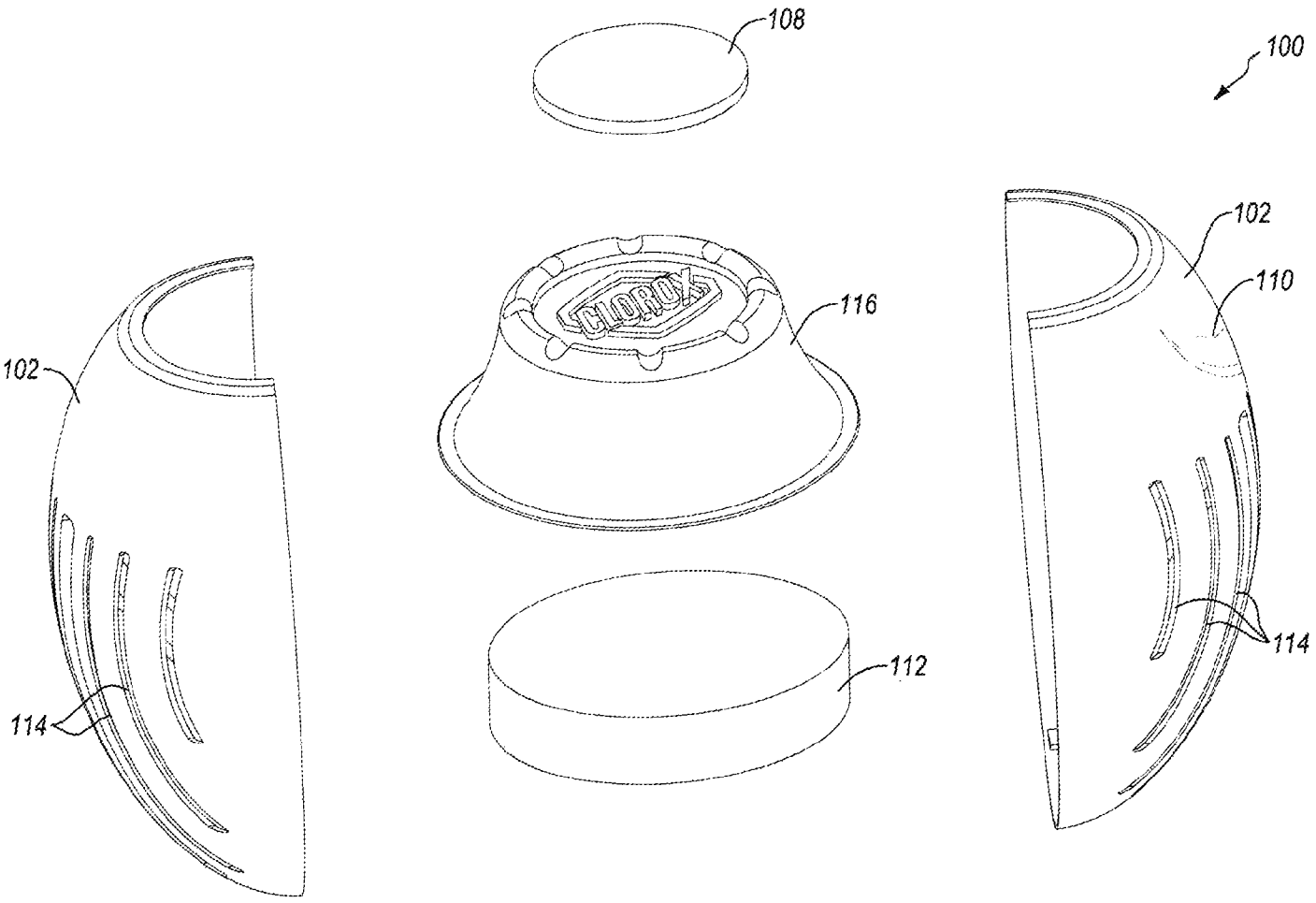
FIG. 1C is an exploded view of the device of FIG. 1A.

In an embodiment, volatile composition 108 may be in the form of a gel. Such a gel may be shape-stable (e.g., capable of substantially maintaining its shape absent support), similar to Jell-O. In another embodiment, the gel may be a viscous liquid, assuming the shape of first compartment 104. In one embodiment, the gel may be transparent or translucent. Where the volatile composition 108 is transparent or translucent, a graphic or image 109 (e.g., molded or embossed) on or in the bottom of the first compartment may be seen through the volatile composition (FIG. 1B). The gel may be colorless or colored. Colored gels may include a dye. Volatile composition 108 may be of any suitable composition configured to release a fragrance or similar volatile component into the air. Exemplary compositions may include a polymeric resin including a fragrance load, such as a PolyIFF, available from International Flavors and Fragrances, Inc (New York, N.Y.). Such PolyIFF compositions may include a proprietary blend of a polyolefin, such as low density polyethylene, optionally with other resins, and may include a fragrance loading of up to 20% or up to 25%. PolyIFF may be injection molded to the desired shape and form.

Another example of a suitable volatile composition is a gelled fragrance concentrate. Such polymer concentrates may include a fragrance loading of up to about 95%, allowing a little of such a composition to go a long way. Such gelled polymer concentrates may exhibit a noticeable shrinking effect as the fragrance volatilizes, which provides a clear visual "end of life" signal to the user as the fragrance is depleted.

Another example of a suitable volatile composition may be similar to the PolyIFF composition described above, with the inclusion of a color changing component. Such a color-changing PolyIFF composition may include a color-changing dye so as to change from an initial color (e.g., green) to another color (e.g., blue) over the course of several (e.g., 4-5) weeks, corresponding to depletion of the fragrance of the composition. Such a change in color also provides a very effective "end of life" signal to the user.

Providing the volatile composition 108 so as to be easily visible at the top of device 100 advantageously provides the user with an easy view of the composition 108, so as to easily recognize when it is time to replace device 100 (or replace composition 108 where device 100 is reusable by recharging compositions 108 and/or 112). As such, in an embodiment, composition 108 is not "caged" within a housing that provides access to air through relatively small inlets, but provides access to air (for diffusion of fragrance into the air) in a configuration in which first compartment 104 includes an open top (e.g., fully open and uncovered as shown in the Figures).

Any suitable fragrance components may be included within volatile composition 108. The concentration of fragrance components within composition 108 may be within any range desired, e.g., from 1% to 95%, 1% to 50%, 1% to 25%, 5% to 25%, etc. Cleaning composition 112 may be solid. The solid may be in the form of a tablet or "puck". In one embodiment, the cleaning composition includes a hypohalite or hypohalite producing species (e.g., a hypochlorite). Exemplary hypohalites and hypohalite producing species include alkali metal and alkaline earth salts of hypohalites (e.g., sodium hypochlorite). Other bleach sources include, but are not limited to alkali metal and alkaline earth salts of haloamines, haloimines, haloimides and haloamides. Of the halite compounds, hypochlorite and compounds producing hypochlorite in aqueous solution may be particularly suitable. Hypobromites and other hypohalites may also be suitable.

Representative hypochlorite and hypochlorite-producing compounds include sodium, potassium, lithium and calcium hypochlorites, chlorinated trisodium phosphate dodecahydrate, potassium and sodium dicholoroisocyanurate and trichlorocyanuric acid. Organic bleach sources suitable for use may include heterocyclic N-bromo and N-chloro imides such as trichlorocyanuric and tribromo-cyanuric acid, dibromo and dichlorocyanuric acid, and potassium and sodium salts thereof, N-brominated and N-chlorinated succinimide, malonimide, phthalimide and naphthalimide. Hydantoins, such as dibromo and dichloro dimethyl-hydantoin, chlorobromodimethyl hydantoin, N-chlorosulfamide (haloamide) and chloramine (haloamine) may also be suitable. Combinations of such components may also be employed.

In another embodiment, the cleaning composition includes one or more an antimicrobial agents, including but not limited to, quaternary ammonium compounds, acids, biguanides, metal salts, carboxylic acids, such as 2-hydroxy-carboxylic acids, phenolics, oxidizing agents and essential oils, etc. The one or more antimicrobial agents may in in the cleaning composition in addition to the hypohalite component or alternatively, the antimicrobial agent may be provided as a replacement to the hypohalite component in the cleaning composition. Other components, such as acids (e.g., solid acids such as boric acid, succinic acid, etc.), surfactants (e.g., to aid in dispersion of the hypohalite in water), fragrance, buffers, and other adjuvants may also be included.

Surfactants may be anionic surfactants, nonionic surfactants, zwitterionic surfactants, amphoteric surfactants, cationic surfactants, ampholytic surfactants, or mixtures thereof. A typical listing of anionic, ampholytic, and zwitterionic classes, and species of these surfactants, is given in U.S. Pat. No. 3,929,678 to Laughlin and Heuring. A list of cationic surfactants is given in U.S. Pat. No. 4,259,217 to Murphy. Each of the above patents is incorporated by reference in its entirety.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A device for dispensing a volatile composition into air and a cleaning composition into toilet tank water, the device being floatable on water and comprising:

(a) a first compartment for housing the volatile composition wherein the first compartment is permeable to air and a permeable portion of the first compartment is positioned above the water line when the device is floating;

(b) a floatation member positioned substantially below the first compartment;

(c) a second compartment for housing the cleaning composition, wherein the second compartment is positioned substantially below the floatation member and has includes one or more inlets to allow fluid communication with the water on which the device is floating during use;

wherein the device has a center of gravity that is below a center of buoyancy and the device has a compound curved bottom, curving in both depth and width without any significant projections therefrom and a transverse cross-sectional area that decreases from the top to a bottom surface; and wherein the one or more inlets each extend vertically down a curved body of the device so that at least a portion of each of the inlets are below the water line.

2. The device of claim 1, wherein the volatile composition comprises a fragrance.

3. The device of claim 1, wherein the volatile composition comprises a dye.

4. The device of claim 1, wherein the volatile composition is a gel.

5. The device of claim 1, wherein the cleaning composition comprises a hypohalite or hypohalite producing component.

6. The device of claim 1, wherein the cleaning composition comprises a surfactant.

7. The device of claim 1, wherein the cleaning composition comprises a polymer.

8. The device of claim 1, wherein the cleaning composition is a solid.

9. The device of claim 1, wherein the flotation member comprises a sealed air-filled compartment.

10. The device of claim 1, wherein the device does not have any attachment to any surface of a toilet tank, instead it is designed to float freely in within the toilet tank.

11. A device for dispensing a volatile composition into air and a cleaning composition into toilet tank water, the device being floatable on water and comprising:

(a) a first compartment for housing the volatile composition wherein a top of the first compartment is open to the air and the top of the first compartment is positioned above a water line when the device is floating;

(b) a floatation member positioned substantially below the first compartment;

(c) a second compartment for housing the cleaning composition, wherein the second compartment includes one or more inlets to allow fluid communication with the water on which the device is floating during use; and wherein the device floats freely in a vertical orientation upon the water and the device has a transverse cross-sectional area that decreases from the top to a bottom surface and a shell-like body shape; and wherein the one or more inlets each extend vertically down the shell-like body of the device so that at least a portion of each of the inlets are below the water line.

12. The device of claim 11, wherein the volatile composition comprises a fragrance.

13. The device of claim 11, wherein the volatile composition is a gel.

14. The device of claim 11, wherein the cleaning composition is a porous solid tablet that provides buoyancy to the device.

15. The device of claim 11, wherein the flotation member is the cleaning composition.

16. The device of claim 14, wherein the device comprises one or more support members to support the porous solid tablet in the second compartment of the device.

17. The device of claim 11, wherein the flotation member comprises a sealed air-filled compartment.

18. The device of claim 11, wherein the device has a center of gravity that is below a center of buoyancy.

19. A device for dispensing a volatile composition into air and a cleaning composition into toilet tank water, the device being floatable on water and comprising:

(a) a first compartment for housing the volatile composition wherein the first compartment is permeable to air and a permeable portion of the first compartment is positioned substantially above the water line when the device is floating;

(b) a second compartment for housing the cleaning composition, wherein the second compartment is positioned at least partially below the water line and includes one or more inlets to allow fluid communication with the water on which the device is floating; and (c) a floatation member positioned substantially above the second compartment; and wherein the device floats freely in a vertical orientation upon the water and the device has a center of gravity that is below a center of buoyancy and the device has a curved and smooth bottom without any significant projections therefrom so that the device will not become entrapped with any components in a toilet tank as the toilet tank is flushed; and wherein the one or more inlets each extend vertically down a curved body of the device so that at least a portion of each of the inlets are below the water line.

* * * * *